US005976748A

United States Patent [19]

Arai et al.

[11] Patent Number: 5,976,748

[45] Date of Patent: Nov. 2, 1999

[54] MAGNETIC TONER FOR MICR PRINTER

[75] Inventors: Takaaki Arai; Tatsuya Yasui; Hiroaki Moriyama, all of Watarai-gun, Japan

[73] Assignee: Kyocera Corporation, Watari-Gun Mie, Japan

[21] Appl. No.: 09/185,491

[22] Filed: Nov. 3, 1998

[30] Foreign Application Priority Data

Nov. 7, 1997 [JP] Japan ..... 9-322245
May 19, 1998 [JP] Japan ..... 10-137153

[51] Int. Cl.[6] ..... G03G 9/083

[52] U.S. Cl. ..... 430/106.6; 430/110; 430/111; 430/903

[58] Field of Search ..... 430/106.6, 903

[56] References Cited

U.S. PATENT DOCUMENTS 3,627,682 12/1971 Hall et al. ..... 430/106.6
4,414,321 11/1983 Miyakawa et al. ..... 430/106.6
4,436,803 3/1984 Ikeda et al. ..... 430/106.6
4,670,368 6/1987 Tosaka et al. ..... 430/106.6
5,389,482 2/1995 Okano et al. ..... 430/106.6
5,439,772 8/1995 Takagi et al. ..... 430/106.6

*Primary Examiner*—Roland Martin
*Attorney, Agent, or Firm*—Fish & Richardson P.C.

[57] ABSTRACT

A magnetic toner for a MICR printer containing a binder resin and a magnetic powder is prepared in such a way that the magnetic powder includes a first magnetic powder having a residual magnetization value within a range of 24 to 40 emu/g and a second magnetic powder having a residual magnetization value within a range of 1 to 24 emu/g (but exclusive of 24 $m^2/g$) and that the residual magnetization value of the magnetic toner for a MICR printer is within a range of 7.0 to 20 emu/g (but exclusive of 7.0 emu/g).

9 Claims, 1 Drawing Sheet

MAGNETIC TONER FOR MICR PRINTER

BACKGROUND OF THE INVENTION

1. Field of the Invention

The present invention relates to a magnetic toner for an MICR printer, which is sometimes called "a toner for magnetic character recognition printing" or simply "a MICR toner", containing a binder resin and a magnetic powder, more particularly to a magnetic toner for an MICR printer having excellent properties in the printing density, the readability, the dispersibility, and the durability.

2. Description of the Related Arts

Recently identification marks called fonts are printed on checks, valuable securities, invoices, tickets and so on, in order to prevent counterfeit or alteration of these. This counterfeit-preventing method using these identification marks is called generally MICR (Magnetic Ink Character Recognition) system, with the toner for printing the fonts being called MICR toner, both of which are disclosed e.g. in Japan Patent Laid-open Pub. Nos. Hei 2-134648, and Hei 5-80582, and U.S. Pat. No. 5,034,298. Conventional MICR toner, however, had the problem that reading errors occurred frequently.

Hence in Japan Patent Laid-open Pub. Nos. Hei 4-358164, Hei 4-358165 and Hei 7-77829 is disclosed MICR toner using two kinds of magnetic powder, whose residual magnetization is controlled within 4.0–7.0 emu/g. The toner, however, had the following problems:

1) reading errors still occurred frequently,
2) it was necessary to enhance image density,
3) durability was low, and
4) dispersibility of the magnetic powder included was low.

SUMMARY OF THE INVENTION

After the inventors of the present invention examined conventional problems zealously, they found that the image density, the reading accuracy, the dispersibility, and the durability of a MICR toner, some of which conflict each other, could be improved by using a first magnetic powder and a second magnetic powder having residual magnetization values within different specific ranges and controlling residual magnetization of a MICR toner at a relatively high value, to complete the present invention. Briefly, the object of the present invention is to provide MICR toner having excellent properties in image density, reading accuracy, durability, and dispersibility of the magnetic powder included.

The present invention relates to a magnetic toner for a MICR printer containing a binder resin and a magnetic powder, the magnetic powder including a first magnetic powder having a residual magnetization value within a range of 24 to 40 emu/g and a second magnetic powder having a residual magnetization value within a range of 1 to 24 emu/g (but exclusive of 24 emu/g), the magnetic toner for a MICR printer having a residual magnetization value within a range of 7.0 to 20 emu/g (but exclusive of 7.0 emu/g).

Combined use of magnetic powder having different residual magnification values in this way makes it possible to easily control image density and reading accuracy of MICR toner. In addition, the residual magnetization value of magnetic powder is closely related to kind, shape and so on of magnetic powder which is to use, so that magnetic powder excellent in properties such as dispersibility can be used by controlling the residual magnetization value of MICR toner in this way. Therefore, durability of MICR toner and dispersibility of the magnetic powder included can also be easily improved.

In addition, to prepare the toner of the present invention, it is preferable that the first magnetic powder has a saturation magnetization value within a range of 80 to 85 emu/g and that the second magnetic powder has a saturation magnetization value within a range of 85 to 90 emu/g (but exclusive of 85 emu/g).

In addition, to prepare the toner of the present invention, it is preferable that the first magnetic powder has an aspect ratio (long diameter/short diameter) within a range of 2.0 to 100 (–) and that the second magnetic powder has an aspect ratio (long diameter/short diameter) within a range of 1.0 to 2.0 (–) (but exclusive of 2.0).

In addition, to prepare the toner of the present invention, it is preferable that the first magnetic powder has a BET value within a range of 13 to 30 $m^2/g$ and that the second magnetic powder has a BET value within a range of 1 to 13 $m^2/g$ (but exclusive of 13 $m^2/g$).

In addition, to prepare the magnetic toner for a MICR printer of the present invention, it is preferable that the first magnetic powder has a bulk density within a range of 1 to 1.2 $g/cm^3$ and that the second magnetic powder has a bulk density within a range of 1.2 to 2.0 $g/cm^3$ (but exclusive of 1.2 $g/cm^3$).

In addition, to prepare the magnetic toner for a MICR printer of the present invention, it is preferable that the first magnetic powder is needle-shaped and that the second magnetic powder is granule-shaped.

In addition, to prepare the magnetic toner for a MICR printer of the present invention, it is preferable that loadings of the magnetic powder are 1 to 60 parts by weight per 100 parts by weight of the binder resin.

In addition, to prepare the magnetic toner for a MICR printer of the present invention, it is preferable that loadings of the second magnetic toner are 10 to 1000 parts by weight when loadings of the first magnetic powder are 100 parts by weight.

In addition, to prepare the magnetic toner for a MICR printer of the present invention, it is preferable that both dry-type silica fine powder and wet-type silica fine powder are used together as external additives.

DESCRIPTION OF THE PREFERRED EMBODIMENTS

Figure 1:
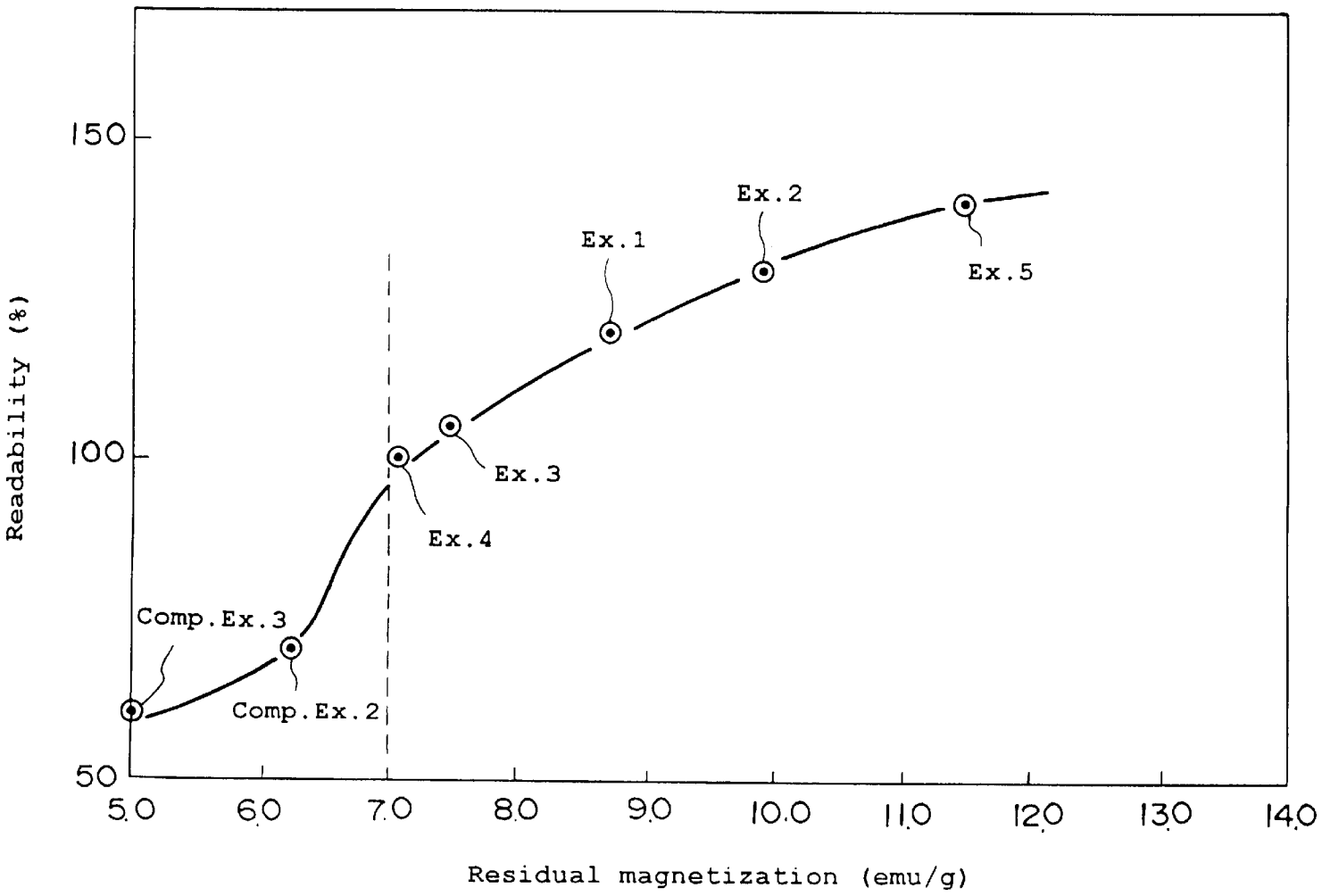
FIG. 1 is a diagram showing relation between residual magnetization value and readability value in the MICR toner.

Embodiments of a magnetic toner for a MICR printer (sometimes called simply as "toner" hereafter) will be concretely described with respect to a binder resin and a magnetic powder, both of which are essential components, waxes and silica particles, both of which are optional components, and form and property of the obtained toner, hereafter.

Binder Resin (1) Kind

As a binder resin used for a magnetic toner for a MICR printer according to the present invention, it is preferable to use thermoplastic resin such as e.g. styrene-based resin, acryl-based resin, styrene-acryl-based resin, polyethylenebased resin, polypropylene-based resin, vinyl chloride-based resin, polyester-based resin, polyamide-based resin, polyurethane-based resin, polyvinyl alcohol-based resin, vinylether-based resin, N-vinyl-based resin, or styrene-butadiene resin, although other kinds of resins can also be used.

It is also preferable that the cross-linking structure is partly introduced to a binder resin in order to improve the stability during storage, the shape-retaining property, or the durability of a toner if an amount of the cross-linking part (amount of gel) is 10 wt. % or lower, more preferably 0.1 to 10 wt. %, as measured using a Soxhlet extractor.

(2) Functional Group in Binder Resin

In addition, as such binder resin, it is preferable to use resin having at least one functional group selected from a hydroxyl group, a carboxyl group, an amino group, and an epoxy group (glicidoxy group), in its molecule, in order to improve dispersibility of magnetic powder.

(3) Molecular Weight of Binder Resin

In addition, it is preferable that the binder resin has two weight-molecular-weight peaks (called "low-molecular-weight peak" and "high-molecular-weight peak"). Concretely, it is preferable that the low-molecular-weight peak is within a range of 3,000 to 20,000 and the high-molecular-weight peak is within a range of 300,000 to 1500,000. If the weight-molecular-weight peaks are in these ranges, a toner can be easily fixed, and durability against offset can also be improved. Weight-molecular weight of binder resin can be measured by use of a molecular-weight-measuring instrument (GPC).

(4) Glass Transition Point of Binder Resin

In addition, it is preferable that glass transition temperature (Tg) of a binder resin is within a range of 55–70° C. In case glass transition temperature of the binder resin is lower than 55° C., the obtained toner may fuse each other so that stability during storage may decrease. On the other hand, in case glass transition temperature of the binder resin is higher than 70° C., the setting property of the toner may decrease. The glass transition temperature of the binder resin can be measured by use of a differential scanning calorimeter (DSC).

Magnetic Powder (1) Kind

As a magnetic powder for a magnetic toner for a MICR printer according to the present invention, it is preferable to use a magnetic powder whose main component is for example iron oxide (magnetite), an iron powder, a cobalt powder, a nickel powder, or ferrites, or to use a magnetic powder in which a metal such cobalt or nickel is doped into iron oxide, although the kind is not limited to these as long as at least two kinds of magnetic powder having different resilient magnetization values are used.

Magnetic powder in which a metal such as cobalt or nickel is doped is especially preferable because the residual magnetization value is high.

(2) Residual Magnetization

With respect to a magnetic powder for a magnetic toner for a MICR printer according to the present invention, it is necessary that the residual magnetization value of a first magnetic powder is within a range of 24 to 40 emu/g and that the residual magnetization value of a second magnetic powder is within a range of 1 to 24 emu/g (but, exclusive of 24 emu/g).

Thus, the residual magnetization value of the obtained MICR toner can be easily controlled so that image density and reading accuracy in a MICR toner can be remarkably improved, by mixing(using) at least two kinds of magnetic powder having different residual magnetization values. In addition, by controlling the residual magnetization value within the range, control of the aspect ratio, the BET value, the bulk density, and other properties becomes easy so that the dispersibility and the durability of the magnetic powder can also be remarkably improved.

Therefore, in order to further improve balance of properties such as the dispersibility of a MICR toner and the image density, it is more preferable that the residual magnetization value of the first magnetic powder is within a range of 25 to 38 emu/g and the residual magnetization value of the second magnetic powder is within a range of 5 to 23 emu/g, and it is even more preferable that the residual magnetization value of the first magnetic powder is within a range of 26 to 35 emu/g and that the residual magnetization value of the second magnetic powder is within a range of 10 to 20 emu/g.

A residual magnetization value can be defined as an amount of magnetic memory under the condition where magnetic field is removed after magnetic field at 10 kilooersted was applied to magnetic powder. More concretely residual magnetization can be calculated by analyzing a hysteresis curve of magnetic powder.

(3) Saturation Magnetization

With respect to a magnetic powder for a magnetic toner for a MICR printer according to the present invention, it is preferable that the saturation magnetization value of the first magnetic powder is within a range of 80 to 85 emu/g and that the saturation magnetization value of the second magnetic powder is within a range of 85 to 90 emu/g (but exclusive of 85 emu/g).

The saturation magnetization value is closely related to the residual magnetization value, which can be finely controlled by mixing(using) at least two kinds of magnetic powder having different saturation magnetization values, so that the image density and the reading accuracy of the obtained toner can be improved. In addition, the controlling of the aspect value, the BET value, and the bulk density becomes easy by controlling the saturation magnetization value within the range so that the dispersibility of the magnetic powder into the binder resin and the durability of the magnetic powder can also be improved.

Therefore, in order to further improve balance of properties such as the dispersibility of a toner and the image density, it is more preferable that the saturation magnetization value of the first magnetic powder is within a range of 81 to 84 emu/g and that the saturation magnetization value of the second magnetic powder is within a range of 86 to 89 emu/g, and it is even more preferable that the saturation magnetization value of the first magnetic powder is within a range of 82 to 83 emu/g and that the saturation magnetization value of the second magnetic powder is within a range of 87 to 88 emu/g.

The saturation magnetization value can be defined as an amount of magnetic memory under the condition where magnetic field at 10 kilooersted was applied to the magnetic powder up to saturation. More concretely, a saturation magnetization value of magnetic powder can be calculated by analyzing a hysteresis curve of the magnetic powder.

(4) Aspect Ratio

With respect to the aspect ratio (long diameter/short diameter) of the magnetic powder for a MICR toner according to the present invention, in case two kinds of magnetic powder having different residual magnetization values (first magnetic powder and second magnetic powder) are used, it is preferable that the aspect ratio of first magnetic powder is within a range of 2.0 to 100 (–) and that the aspect ratio (long diameter/short diameter) of second magnetic powder is within a range of 1.0 to 2.0 (–) (but exclusive of 2.0).

The dispersibility of the magnetic powder into the binder resin can be remarkably improved by mixing(using )two kinds of magnetic powder, one having an aspect value of 2.0 or more, the other having an aspect value lower than 2.0. In addition, the dispersibility of the magnetic powder is improved so that the percentage of the magnetic powder in the form of aggregate tends to decrease. Therefore, the percentage of the MICR toner which was cracked or magnetic powder was lost tends to decrease so that the durability of the MICR toner can be remarkably improved. In addition, the magnetic powder having a large aspect value has a large residual magnetization value so that image density and reading accuracy can be remarkably improved in case the toner in which such magnetic powder is included is used.

Therefore, in order to further improve the balance of properties such as the dispersibility of the magnetic toner in the MICR toner and the printing density, it is more preferable that the aspect ratio of the first magnetic powder is within a range of 2.5 to 10.0 (–) and that the aspect ratio of the second magnetic powder is within a range of 1.2 to 1.7 (–), and it is even more preferable that the aspect ratio of the first magnetic powder is within a range of 3.0 to 5.0 (–) and that the aspect ratio of the second magnetic powder is within a range of 1.3 to 1.6 (–)

(5) BET Value

With respect to the BET value of the magnetic powder for a MiCR toner according to the present invention, in which two kinds of magnetic powder, first magnetic powder and second magnetic powder, are used, it is preferable that the BET value of first magnetic powder is within a range of 10 to 30 $m^2/g$ and that the BET value of second magnetic powder is within a range of 1 to 10 $m^2/g$ (but exclusive of 10 $m^2/g$) although magnetic powder having other BET values can also be used.

The residual magnetization value and dispersibility of the obtained toner can be easily controlled by mixing (using) at least two kinds of the magnetic powder having the different BET values. In addition, the image density and the reading accuracy of toner can be remarkably improved, and dispersibility of the magnetic powder into binder resin and durability of the magnetic powder can also be improved, by constituting in this way. The BET value can be determined as a specific surface area by the BET adsorption method.

Therefore, in order to further improve balance of properties such as dispersibility of toner and image density, it is more preferable that the BET value of the first magnetic powder is within a range of 11 to 25 $m^2/g$ and that the BET value of the second magnetic powder is within a range of 2 to 9 $m^2/g$, and it is even more preferable that the BET value of the first magnetic powder is within a range of 12 to 20 $m^2/g$ and that the BET value of the second magnetic powder is within a range of 4 to 8 $m^2/g$.

(6) Bulk Density

With respect to the bulk density of magnetic powder for use in the MICR toner according to the present invention, in which two kind of magnetic powder, the first magnetic powder and the second magnetic powder, are used, it is preferable that the bulk density of the first magnetic powder is within a range of 1 to 1.2 $g/cm^3$ and the bulk density of the second magnetic powder is within a range of 1.2 $g/cm^3$ to 2.0 $g/cm^3$ (but exclusive of 1.2 $g/cm^3$) although magnetic powder having the other bulk densities can also be used.

The residual magnetization value and the dispersibility of the obtained toner can be easily controlled by mixing (using) at least two kinds of magnetic powder having the different bulk density values in this way. The image density and the reading accuracy of toner can be remarkably improved, and the dispersibility of the magnetic powder into the binder resin and the durability of the magnetic powder can be improved, by constituting in this way.

Therefore, in order to further improve the balance of properties such as the dispersibility of the toner and the image density, it is more preferable that the bulk density of the first magnetic powder is within a range of 1.05 to 1.2 $g/cm^3$ and that the bulk density of the second magnetic powder is within a range of 1.3 to 1.6 $g/cm^3$, and it is even more preferable that the bulk density of the first magnetic powder is within a range of 1.1 to 1.2 $g/cm^3$ and that the bulk density of the second magnetic powder is within a range of 1.3 to 1.5 $g/cm^3$.

(7) Shape

As the shape of the magnetic toner for use in the MICR toner according to the present invention, e.g. needle-shaped, granular, globular, and amorphous shapes can be used, although the magnetic powder having other shapes can also be used.

Here, needle-shaped magnetic powder has generally a property that it has the large values of residual magnetization, the retainability, the BET value, and the aspect ratio (long diameter/short diameter), although it has the small values of the bulk density and the saturation magnetization, and the low dispersibility into the binder resin, so that it can be preferably used.

The granular magnetic powder has generally relatively high values of the residual magnetization, the saturation magnetization, the retainability, and the BET value, and the high dispersibility into the binder resin, but has relatively the small values of the aspect ratio (long diameter/short diameter) and the bulk density.

Globular(sphelic) magnetic powder generally has the small values of the residual magnetization, the retainability, and the BET value and the aspect ratio (long diameter/short diameter), but relatively has the large values of the bulk density, and the saturation magnetization, and the good dispersibility into the binder resin.

In addition, with respect to the two kinds of the magnetic powder having the different residual magnetization values according to the present invention which are named the first and the second magnetic powders, respectively, it is preferable that one is needle-shaped and the other is glanular.

The residual magnetization value and the dispersibility of the obtained toner can be easily controlled by mixing(using) at least two kinds of the magnetic powder having the different shapes in this way. There is a problem that needle-shaped magnetic powder has a small saturation magnetization value and the poor dispersibility although it has a large residual magnetization value and a large BET surface area in general. On the other hand, there is a problem that granular magnetic powder has a relatively lower residual magnetization value and a relatively small BET surface area than the needle-shaped magnetic powder although it has the good dispersibility and a large saturation magnetization value in general.

Therefore, it is difficult to obtain the toner having well-balanced properties with respect to mutually conflicting properties such as the residual magnetization and the dispersibility if only one of the needle-shaped and the granular magnetic powder is used. Therefore, the image density and reading accuracy of the toner can be remarkably improved and the dispersibility of the magnetic powder into the binder resin and the durability of the magnetic powder can be easily improved by constituting in this way.

(8) Loadings

With respect to the loading of magnetic powder (first and second magnetic powders) for use in the MICR toner according to the present invention, it is preferable that the loading of the magnetic powder are within a range of 1 to 60 parts by weight per 100 parts by weight of the binder resin, although other loading can also be adopted. In case the loading of the magnetic powder are less than 1 part by weight, the overlapping phenomenon may occur and the reading accuracy may decrease. In case the loading of the magnetic powder are larger than 60 parts by weight, the dispersibility or the stirring efficiency may decrease and the image density and other properties may decrease.

Therefore, in order to balance the image density, the dispersibility, and the other properties of the MICR toner well, it is more preferable that the loading of the magnetic powder is within a range of 20 to 55 parts by weigh per 100 parts by weight of the binder resin, and it is even more preferable that the loading is within a range of 30 to 50 parts by weight.

Then, the loading ratio of the two kinds of magnetic powder having different residual magnetization values, the first magnetic powder and the second magnetic powder, will be described below. The loadings of the second magnetic powder are preferably within a range of 10 to 1000 parts by weight when the loading of the first magnetic powder are 100 parts by weight, although other loadings can also be adopted. In case the loading of the second magnetic powder is less than 10 parts by weight, the dispersibility of the magnetic powder and the durability of the MICR toner may decrease. On the other hand, in case the loading of the second magnetic powder is more than 1000 parts by weight, the image density and other properties may decrease.

Therefore, it is more preferable that the loading of second magnetic powder are within a range of 20 to 500 parts by weight when the loadings of the first magnetic powder is 100 parts by weight, and even more preferably the loading of the second magnetic powder is within a range of 50 to 300 parts by weight.

(9) Surface Treatment

Surface treatment of the magnetic powder will be described below. With respect to the magnetic toner for a MICR printer according to the present invention, in order to improve the dispersibility and the durability, it is preferable to treat both or either of the first and the second magnetic powders using a surface treating agent. As surface-treating agents for that, it is preferable to use a cationic surfactant, an anionic surfactant, an amphoteric surfactant, a silane-based coupling agent, a titanium-based coupling agent, an aluminum-based coupling agent, a phenol-based resin, an epoxy-based resin, a cyanate-based resin, or an urethane-based resin, or the combination of at least two from these agents.

The loading of the surface-treatment agent is preferably within a range of 0.1 to 100 parts by weight per 100 parts by weight of the magnetic powder. In case the loading of the surface-treatment agent are less than 0.1 parts by weight, enough effect of surface treatment may not be obtained. On the other hand, in case the loadings of the surface-treatment agent are more than 100 parts by weight, image density of the toner may decrease.

Therefore, in order to balance the surface-treating effect, the image density of the toner, and other properties well, the loading of the surface-treating agent is preferably within a range of 0.5 to 20 parts by weight per 100 parts by weight of the magnetic powder, more preferably within a range of 1.0 to 10 parts by weight.

Additives (1) Waxes

To the magnetic toner for a MICR printer according to the present invention, in order to raise the image density and to effectively prevent the offset to a reading head and the image smearing, it is preferable to add waxes.

As the kind of waxes, it is preferable to use e.g. a polyethylene wax, a polypropylene wax, a fuluorocarbon-based wax(Teflon), or Fischer-Tropsch wax, although other waxes can also be used. It is more effectively prevent offset to a reading head and image smearing by adding these waxes.

It is especially preferable to use a Fischer-Tropsch wax. It is more effectively prevent offset to a reading head and image smearing by adding said wax. A Fischer-Tropsch wax is an almost linear hydrocarbon compound containing less iso-structural molecule or side chain produced by the Fischer-Tropsch reaction which is a catalytic hydrogenation of carbon monoxide.

A Fischer-Tropsch wax having a weight-average-molecular-weight of 1000 or more and an endothermic bottom peak in DSC is more preferable. As such a Fischer-Tropsch wax, Sazole Wax C1 (high-molecular-weight grade by crystallization of H1; endothermic bottom peak, 106.5° C.), Sazole Wax C105 (product by purifying C1 by fractional distillation; endothermic bottom peak, 102.1° C.), and Sazole Wax SPRAY (fine particulate product of C105; endothermic bottom peak, 102.1° C.) are available from Sazole Co.

It is preferable that the loading of the waxe is within a range of 1 to 5 wt. % when the total amount of the toner is 100 wt. %, although other loading can also be adopted. In case the loadings of the waxes are less than 1 wt. %, the offset to the reading head, the image smearing, and other troubles may not be effectively prevented. In case the loadings of the waxes are more than 5 wt. %, toner may be fused so that stability during storage may decrease.

(2) Charge-controlling Agent

With respect to the magnetic toner for a MICR printer, in order to improve the electrification level and an electrification rate (index of electrification to specific charge level during short time) and to obtain excellent fluidity, it is preferable to add a charge-regulating agent.

There are two types of charge-regulating agent i.e. a charge-controlling agent (CCA) having a function to control charge (electrification amount) within a specific range and a charge-controlling resin (CCR) having a function to reinforce charge (electrification amount). Therefore, for the magnetic toner for a MICR printer according to the present invention, it is preferable to add both or either of the charge-controlling agent and the electrification-reinforcing resin.

As the charge-controlling agent (CCA), azines, direct dyes comprising azines, nigrosin compounds, metallic salts, alkoxylated amines, alkylamides, and quaternary ammonium salts, and combination of two of these compounds can be used. In particular, as nigrosin compounds enable rapid start-up of electrification amount and easy control of saturated electrification amount, they are most preferable for the present invention.

As the charge-controlling resin (CCR), a resin or an oligomer having quaternary ammonium salt; a resin or an oligomer having carboxylic acid salt; a resin or an oligomer having carboxylic acid residue or combinations of two of these compounds can be used.

It is most preferable to use styrene-acryl copolymer having quaternary ammonium salt, carboxylic acid salt, or carboxylic acid residue, which allows further promotion of electrification amount, in the present invention.

The total loadings of charge-regulating agent comprising the charge-controlling agent and the charge-controlling resin will be described hereafter. It is preferable to determine the loadings of the charge-regulating agent considering the desired charge amount. Concretely, it is preferable that the loadings of a charge-control agent are within a range of 0.1 to 10 wt. % when the total amount of the magnetic toner for a MICR printer is 100 wt. %. In case the loadings of the charge-regulating agent is less than 0.1 wt. %, regulation of charge may not be effectively functioned. On the other hand, in case the loadings of charge-regulating agent is more than 10 wt. %, the dispersibility and the durability of toner may decrease. Therefore, in order to balance the charge-regulating function, the durability of the toner, and other properties well, the loadings of the charge-regulating agent are more preferably within a range of 0.5 to 8 wt. %, even more preferably within a range of 1.0 to 5 wt. %.

(3) Internal Additives

It is also preferable to add a coloring agent, a dye, a pigment, a coupling agent, silica powders and so on, as internal additives other than the above-mentioned one, to MICR toner according to the present invention.

(4) External Additives

It is also preferable to add external additive(s) to MICR toner according to the present invention. In order to more effectively control fluidity of the MICR toner, it is preferable to add silica powders (silica fine powder).

In this case, it is preferable to add both dry-type silica fine powder and wet-type silica fine powder. By using a plural kinds of silica fine powder in this way, change of electrification of the MICR toner by environmental condition (humidity) can be effectively prevented. Dry-type fine powder and wet-type silica fine powder will be described in more detail hereafter.

Dry-type Silica Fine Powder

It is preferable to use e.g. 1) dry-type silica fine powder to which positively charged polar group and hydrophobic group were introduced or 2) dry-type silica fine powder to which positively charged polar group was introduced, followed by treatment with an agent to make material hydrophobic, although other kinds of dry-type silica fine powder can also be used.

Introduction weight ratio of positively charged polar group and hydrophobic group to dry-type silica fine powder is preferably each 3–25%, more preferably each 5–20%, as the coupling agent. Treatment weight ratio of hydrophobic group to dry-type silica fine powder is preferably 1–25%, more preferably 3–20%, as the coupling agent.

By controlling the introduction weight ratio and treatment weight ratio within these ranges, an appropriate blow-off electrification amount e.g. +50 $\mu$C/g or more and an appropriate hydrophobic degree e.g. 50% or more can be obtained, so that excellent electrification can be obtained even under hot and humid environmental condition.

Wet-type Silica Fine Powder

It is preferable to use e.g. 1) wet-type silica fine powder to which positively charged polar group and negatively charged fluorinated polar group were introduced or 2) wet-type silica fine powder which was treated with an agent to make material hydrophobic, although other kinds of wet-type silica fine powder can also be used.

Introduction weight ratio of positively charged polar group to wet-type silica fine powder is preferably 3–25%, more preferably each 5–20%, as the coupling agent. Introduction weight ratio of negatively charged fluorinated polar group to wet-type silica fine powder is preferably 1–25%, more preferably each 3–20%, as the coupling agent. Treatment weight ratio of an agent to make material hydrophobic to wet-type silica fine powder is preferably 1–25%, more preferably each 3–20%.

By controlling the introduction weight ratio and treatment weight ratio within these ranges, an appropriate blow-off electrification amount e.g. +100 $\mu$C/g or more and an appropriate hydrophobic degree e.g. 55% or more can be obtained, so that excellent electrification can be obtained even under hot and humid environmental condition.

Positively Charged Polar Group, Hydrophobic Group, Negatively Charged Fluorinated Polar Group, Hydrophobifying Agent Positively charged polar group, hydrophobic group, negatively charged fluorinated polar group, and hydrophobifying agent will be described hereafter.

For a positively charged polar group, e.g. an amino group can be used, which can be easily introduced using an aminosilane coupling agent or the like. For a hydrophobic group, an alkyl group or the like can be used, which can be easily introduced using an alkylsilane coupling agent or the like. For a negatively charged fluorinated polar group, a fluorinated alkyl group or the like can be used, which can be easily introduced using a fluorinated alkyl alkylsilane coupling agent (fluorinated silane coupling agent) or the like. As an agent to make material hydrophobic, e.g. silicone oil, an alkylsilane coupling agent or the like can be used.

As a preferable aminosilane coupling agent to introduce positively charged polar group, the following compounds can be used:

e.g.

$H_2N(CH_2)_2NH(CH_2)_3Si(OCH_3)_3$, $H_2N(CH_2)_2NH(CH_2)_3Si(CH_3)(OCH_3)_2$, $H_2N\ (CH_2)_2NH\ (CH_2)_2Si\ (OCH_3)_3$, $H_2N\ (CH_2)_2NH\ (CH_2)_2NH\ (CH_2)_2Si\ (OCH_3)_3$, $H_2N\ (CH_2)_2Si\ (OCH_3)_3$, and $C_6H_5NH\ (CH_2)_3Si\ (OCH_3)_3$.

As a preferable alkylsilane coupling agent to introduce hydrophobic group, the following compounds can be used:

e.g.

$CH_3Si\ (OCH_3)_3$, $CH_3Si\ (OCH_2CH_3)_3$, $(CH_3)_2Si\ (OCH_3)_2$, $CH_3\ (CH_2)_2Si\ (OCH_3)_3$, $CH_3\ (CH_2)_5Si\ (OCH_3)_3$, $n\text{-}C_{10}H_{21}Si\ (OCH_3)_3$, and $C_6H_5Si\ (OCH_3)_3$.

As a preferable fluorinated alkylsilane coupling agent to introduce negatively charged fluorinated polar group, the following compounds can be used:

e.g.

$CF_3\ (CH_2)_2Si\ (OCH_3)_3$, $CF_3\ (CF_2)_7\ (CH_2)_2Si\ (OCH_3)_3$, $CF_3\ (CH_2)_2Si\ (CH_3)\ (OCH_3)_2$, $CF_3\ (CF_2)_3\ (CH_2)_2Si\ (OCH_3)_3$, $CF_3\ (CF_2)_4\ (CH_2)_3Si\ (OCH_3)_3$, $CF_3\ (CF_2)_2\ (CH_2)_6Si\ (OCH_3)_3$, $CF_3\ (CF_2)_6\ (CH_2)_2Si\ (OCH_3)_3$, and $CF_3\ (CF_2)_7\ (CH_2)_2Si\ (CH_3)\ (OCH_3)_2$.

As preferable silicone oil, dimethyl silicone oil, methyl phenyl silicone oil, alkyl-modified silicone oil, methyl hydrogen silicone oil and so on can be used.

Treatment

Method to treat silica fine powder with a coupling agent will be described hereafter. It is preferable to homogeneously add a diluent of a coupling agent with an organic solvent to silica fine powder, the obtained mixture was heated in an oven or the like and cooled, followed by mixing/crushing the cooled mixture using a blender, although other methods can also be used. This is a dry-type method.

It is also preferable to homogeneously add a diluent of a coupling agent in water to a slurry of silica fine powder which was previously prepared by dispersing silica fine powder into water, the obtained mixture was heated in an oven or the like and cooled, followed by mixing/crushing the cooled mixture using a blender. This is a wet-type method.

In case both dry-type silica fine powder and wet-type silica fine powder are used, addition ratio of dry-type silica fine powder to the toner is preferably 0.1–1.2 wt. %, more preferably 0.2–1.0 wt. %, in order to obtain excellent addition effect.

In case both dry-type silica fine powder and wet-type silica fine powder are used, the mixing ratio of dry-type silica fine powder to wet-type silica fine powder is preferably 1/10–10/1, more preferably 3/7–7/3, in order to obtain more excellent addition effect.

MICR Toner (1) Residual Magnetization

In the present invention, it is necessary that the residual magnetization of magnetic toner for a MICR printer is within a range of 7.0 to 20 emu/g (but exclusive of 7,0 emu/g). Because in case the residual magnetization value is 7.0 emu/g or smaller, image density and/or reading accuracy of the toner may remarkably decrease. And because on the other hand, in case the residual magnetization value is larger than 20 emu/g, the reading accuracy, the dispersibility, and the durability of the toner may decrease. Therefore, in order to achieve more excellent reading accuracy of the toner, the residual magnetization of the magnetic toner for a MICR printer is more preferably within a range of 8 to 18 emu/g, even more preferably within a range of 10 to 15 emu/g.

(2) Saturation Magnetization

The values of saturation magnetization of the MICR toner will then be described. Although the values of saturation magnetization of such MICR toner are not particularly restricted, it is preferable that it is within a range of 20 to 45 emu/g for example. If the saturation magnetization value in toner is less than 20 emu/g, the image density and the reading accuracy of the toner remarkably may decrease. On the contrary, if the saturation magnetization value in toner is more than 45 emu/g, reading accuracy of toner may remarkably decreases again.

Therefore, in order to achieve more excellent readability and other properties in toner, the saturation magnetization of magnetic toner for a MICR printer is more preferably within a range of 25 to 40 emu/g, even more preferably within a range of 30 to 32.5 emu/g.

(3) Shape

Next, the shape of magnetic toner for a MICR printer will be described. It is p referable that the shape is globular or ellipsoidal because these shapes improve readability and image density of toner and allow easy production although magnetic toner having other shapes can also be used.

It is preferable that the average particulate size of the MICR toner is within a range of 1 to 20 μm although magnetic toner having other sizes can also be used. In case the size is outside the range, reading accuracy and/or image density may decrease and production controlling the size may be difficult. Therefore, the average particulate size of toner is more preferably within a range of 4 to 15 μm, even more preferably within a range of 5 to 13 μm.

(4) Production Method

Next, the production of magnetic toner for a MICR printer will be described. The toner having a desired average particulate size can be obtained by homogeneously blending a binder resin and a magnetic powder using e.g. a propeller mixer, a kneader, a V-blender, a Henshel mixer and so on; crushing the obtained mixture; and classifying the obtained particles.

EXAMPLE

The present invention will be described in greater detail using examples hereafter. It is naturally to be appreciated that the following description is merely exemplary and that the scope of the invention is not intended to be limited by the following description if otherwise specified.

EXAMPLE 1

(1) Preparation of MICR Toner

Into a blending container were contained two kinds of magnetic powder having different residual magnetization values i.e. 20 parts by weight of a first iron oxide and 20 parts by weight of a second iron oxide.

Then, 100 parts by weight of styrene-acryl copolymer (softening point, 123° C.; Tg, 65° C.) and 2.5 parts by weight of Fischer-Tropsch wax (Sazole Wax C2; weight-average-molecular-weight, 1262) were added to the mixture, and were homogeneously mixed/dispersed. Into the first and second magnetic powders was added and mixed 1 part-by-weight of γ-aminopropyltriethoxysilane per 100 parts by weight of each, to previously treat the surfaces of the magnetic powders.

The obtained mixture was then crushed using a crusher, followed by classification to give toner particles having an average particle size of 10 μm, which was distributed in such a way that 80 wt. % of the particles had a particle size of 7 to 13 μm.

Dry-type silica fine powder treated with an agent to make material hydrophobic as an external additive was then added to the obtained MICR toner at a weight ratio of 0.5% to give MICR toner according to the present invention, which was evaluated, wherein the dry-type silica fine powder treated with an agent to make material hydrophobic was prepared by introducing amino group to dry-type silica fine powder using γ-aminopropyltriethoxysilane and further treating with silicone oil.

| For | First Iron Oxide Needle-shaped | Second Iron Oxide Granular |
|---|---|---|
| Residual magnetization (emu/g) | 30.5 | 18.1 |
| Saturation magnetization (emu/g) | 84.0 | 87.0 |
| Average particle size (μm) | 0.7 | 0.4 |
| Aspect ratio (long diameter/short diameter) | 3.57 | 1.33 |
| BET surface area ($m^2$/g) | 15.5 | 3.8 |
| Bulk density (g/$cm^3$) | 1.1 | 1.4 |
| Retainability (Oe) | 335.0 | 221.0 |

(2) Evaluation of Magnetic Powder for MICR Printer

Evaluation of the obtained magnetic toner per se for a MICR printer was carried out by containing the toner in a printer (Kyocera Co., Ltd., Ecosys, FS-3700) and continuously printing a font (E-13B type) on checks with respect to image density and so on.

(2-1) Evaluation with Respect to Residual Magnetization and Saturation Magnetization Residual magnetization and saturation magnetization of the obtained magnetic toner for a MICR printer were measured. The obtained result is shown in Table 1.

(2-2) Evaluation with Respect to Dispersibility

Magnetic toner for a MICR printer was cut using a microtome MT6000-XL (RMC Co.). Then, the cross section of the toner was observed using an electron micrograph and dispersibility of the magnetic powder in the MICR toner was evaluated using the following criteria. The result is shown in table 1, wherein "Fair" indicates that the dispersibility is within an acceptable range and "Good" indicates that the powder has a preferred use as the MICR toner, although "Bad" indicates that it is impossible to use as the MICR toner due to a poor dispersibility of the magnetic toner.

Good: No aggregate of magnetic powder was observed.

Fair: Small aggregates of magnetic powder were observed.

Bad: Aggregates of magnetic powder were observed.

(2-3) Evaluation of Durability

Durability of the MICR toner was evaluated by containing the obtained MICR toner in a developing container of a printer (Kyocera Co., Ltd., Ecosys FS-3700) followed by electrostatically continuous operation of the printer at a rotation speed of 18 PPM (Page per Minutes) for 10 days and observation of toner degraded (cracked) by the test using the following criteria. In "the electrostatically continuous operation", the MICR toner is mixed/fluidized under the same condition as normal printing except that no paper is fed with the MICR toner mixing and developing bias being applied. The result is shown in Table 1, wherein "Fair" means that the durability is within an acceptable range and "Good" means that the powder has a preferred use as the MICR toner although "Bad" indicates that it is impossible to use as the MICR toner due to its poor durability.

Good: Separation of magnetic powder from the surface of toner was not observed.

Fair: Separation of aggregated magnetic powder from the surface of toner was not observed.

Bad: Remarkable separation of magnetic powder from the surface of toner was observed.

(2-4) Evaluation of Image Density

Image density was evaluated by containing the obtained MICR toner in a developing container of a printer (Kyocera Co., Ltd., Ecosys FS-3700), printing a solid brown pattern on checks, and measuring density of the printed image of the printed MICR toner using a Macbeth densitometer (Macbeth Co. reflection type densitometer, RD914). The result is shown in Table 1.

(2-5) Evaluation of Overlapping Property

Overlapping property of the obtained MICR toner was evaluated. The result is shown in Table 1. Evaluation was carried out by comparing with each sample having a limit of overlapping corresponding to the number of printed sheets and categorizing into levels 1–5. In this categorization, Level 4 or more is within an acceptable range from the viewpoint of readability or other properties. Levels 1–3 is within an unacceptable range due to a significant degradation of the readability or other properties.

Level 5: No overlapping was observed in the background.

Level 4: Trace overlapping could be observed in the background using a loupe.

Level 3: Trace overlapping could be observed in the background by watching.

Level 2: Overlapping could be observed in the background by watching.

Level 1: Vertical lines and so on appeared in the background, and remarkable overlapping was observed.

(2-7) Evaluation of Readability

Readability of the obtained MICR toner was evaluated using a MICR toner reader, MICR qualifier (RDM Co.). The readability value within a range of 80 to 200% means that the font could be appropriately read. The obtained result is shown in FIG. 1.

In FIG. 1, residual magnetization value (emu/g) of the MICR toner is shown in X-axis, and the readability is shown in Y-axis. As shown in FIG. 1 comprising a curve including data of Example 1, as the residual magnetization value went down from 7.0 emu/g, the readability value dropped comparatively rapidly. Therefore, the excellent readability value (%) can be given by limiting the residual magnetization value of the MICR toner within a specific range.

In addition, it was found that properties such as readability (%) and dispersibility are lowered again as the residual magnetization value increases further. Therefore, it is necessary to limit the residual magnetization value of the MICR toner to 20 emu/g or lower.

TABLE 1

| | Example 1 | Example 2 | Example 3 | Comparative example 1 | Comparative example 2 |
|---|---|---|---|---|---|
| Form of magnetic powder | Granular/needle-shaped | Granular/needle-shaped | Granular/needle-shaped | Needle-shaped | Pearl-shaped |
| Amount of magnetic powder (wt. part) | 40 (20/20) | | 40 (10/30) | 40 | 40 |
| Residual magnetization | 8.72 | 9.96 | 7.48 | 11.2 | 6.24 |
| Saturation magnetization | 32.2 | 31.9 | 32.5 | 31.6 | 32.8 |
| Dispersibility | Good | Fair | Good | Bad | Good |
| Durability | Good | Good - Fair | Good | Fair - Bad | Good |
| Overlapping property | 4.0 | 4.0 | 4.0 | 3.5 | 4.5 |
| Image density | 1.25 | 1.3 | 1.2 | 1.3 | 1.15 |
| Readability | 120 | 130 | 105 | 140 | 70 |

*Values in the parentheses indicate the weight ratio of granular/needle-shaped.

EXAMPLES 2 AND 3

MICR toner was prepared by the same method as shown in Example 1 except that the blending ratio of the first iron oxide to the second iron oxide was changed, and evaluated. In Example 2, 30 parts by weight of the first iron oxide and 10 parts by weight of the second iron oxide were added to 100 parts by weight of binder resin. In Example 3, 10 parts by weight of the first iron oxide and 30 parts by weight of the second iron oxide were added to 100 parts by weight of binder resin. The obtained result is shown in Table 1.

EXAMPLES 4 to 6

MICR toner was prepared by the same method as shown in Example 1 except that the loadings of the (first and second) magnetic powder were changed to 30 parts by weight (Example 4) and 50 parts by weight (Example 5) relative to 100 parts by weight of the binder resin, keeping the blending ratio of the first iron oxide to the second iron oxide at 50:50, and properties with respect to residual magnetization, fixing and so on were evaluated.

Fixing property was evaluated as follows. Fixing temperature was set at 190° C., the instrument was cooled for 10 min by turning off the switch, the switch was turned on again, an image-evaluating pattern (solid pattern) was continuously printed on 5 sheets to give image for measurement. Then, a brass weight wrapped with cotton cloth (1 kg weight) was shuttled 10 times. Fixing property was evaluated by measuring image density before and after this procedure using Macbeth reflection densitometer and determining fixing coefficients of the density (density before procedure/density after procedure). Classic crest paper was used for the evaluation. The obtained result is shown in Table 2.

Good: Fixing coefficient is higher than 95%.

Fair: Fixing coefficient is lower than 95% but not lower than 90%.

Bad: Fixing coefficient is lower than 90%.

TABLE 2

| | Comparative example 3 | Example 4 | Example 1 | Example 5 |
|---|---|---|---|---|
| Form of magnetic powder | Granular/ needle-shaped | Granular/ needle-shaped | Granular/ needle-shaped | Granular/ needle-shaped |
| Magnetic powder (wt. part) | 20 (10/10) | 30 (15/15) | 40 (20/20) | 50 (25/25) |
| Residual magnetization | 3.8 | 7.1 | 8.72 | 14.0 |
| Saturation magnetization | 15.1 | 23.6 | 32.2 | 42.5 |
| Dispersibility | Good | Good | Good | Good |
| Durability | Good | Good | Good | Good |
| Overlapping property | 2.0 | 3–3.5 | 4.0 | 5.0 |
| Image density | 1.4 | 1.3 | 1.25 | 1.2 |
| Readability | 60 | 100 | 120 | 140 |
| Fixing property | Good | Good | Good | Good |

*Values in the parentheses indicate the weight ratio of granular/needle-shaped.

COMPARATIVE EXAMPLES 1 to 3

In Comparative examples 1 and 2, MICR toner was prepared by the same method as Example 1 except that 40 parts by weight of either the first iron oxide or the second iron oxide were used for 100 parts by weight of binder resin, and residual magnetization and other properties in the toner were evaluated. The obtained result is shown in Table 1.

As shown in Table 1, in Comparative example 1, as only needle-shaped magnetic powder was used, a high residual magnetization value was obtained, but dispersibility and durability were not enough. In Comparative example 2, as only granular magnetic powder was used, dispersibility and durability were excellent, but readability was not enough.

In Comparative example 3, MICR toner was prepared by the same method as Example 1 except that the loadings of the (first and second ) magnetic powder were 20 parts by weight relative to 100 parts by weight of binder resin, keeping the blending ratio of the first iron oxide to second iron oxide at 50:50, and properties with respect to residual magnetization, fixing and so on were evaluated. The obtained result is shown in Table 2.

As can be seen from the result, in Comparative example 3, in which needle-shaped and granular magnetic powder having different aspect ratios were used, as the residual magnetization value is smaller than 7.0 emu/g, readability was not enough.

EXAMPLES 7–13

(1) Preparation of MICR Toner

Into a blending container were contained 25 wt. parts of iron oxide 1 and 25 wt. parts of iron oxide 2 which were used in Example 1 as magnetic powder.

Then, 10 wt. parts of styrene-acryl copolymer (softening point, 123° C.; Tg, 65° C.), 4 wt. parts of a charge-controlling agent (TP-415, Hodogaya Chem. Co.), and 2.5 wt. parts of wax (NP-055, Mitsubishi Chem. Co.) were added to the mixture, and were homogeneously mixed/dispersed to give a magnetic powder-including mixture, wherein the surface of iron oxide 1 and iron oxide 2 had been treated with γ-aminopropyltriethoxysilane in a way similar to Example 1.

The obtained mixture was then crushed using a crusher, followed by classification to give MICR toner powders having an average powder size of 10 μm, which was distributed in such a way that 80 wt. % of the powders had a powder size of 7–13 μm.

(2) Preparation of External Additive

Dry-type Fine Silica Powder "a"

A diluent containing 5 g of N-β-aminoethyl-γ-aminopropyltrimethoxysilane and 5 g of propyltrimethoxysilane in 15 g of toluene was slowly dropped to 100 g of fumed silica (Aerosil, Japan Aerosil Co.) with stirring by Vaitamix, followed by strong stirring for 10 min. The obtained mixture was then heated at 150° C. in an oven and crushed to give dry-type silica fine powder "a" having positively charged polar group (amino group) and hydrophobic group (propyl group) on its surface.

Blow-off electrification amount and hydrophobic degree of the obtained dry-type silica fine powder "a" and other dry- and wet-type silica fine powder were determined as follows.

Wet-type silica fine powder was homogeneously mixed with ferrite carrier (resin-uncoated), the weight was measured, and a blow-off electrification amount was determined at a blow pressure of 0.8 $KgJ/m^2$ for 30 sec using a blow-off measuring device TB-200 (Toshiba Co.).

Fifty milliliter of pure water was contained in a 200-ml beaker, 0.2 g of dry-type silica fine powder "a" was added into the water, and methanol dehydrated with anhydrous sodium sulfate was dropped into the beaker using a buret with stirring until no silica was observed on the surface of water. Hydrophobic degree was determined from the amount (X, ml) of added methanol using the following equation (1):

$$\text{Hydrophobic degree } (\%)=(X/(50+X))\times 100 \quad (1)$$

TABLE 3

| Kind of silica | Blow-Off electrification amount (μC/g) | Hydrophobification degree (%) |
|---|---|---|
| a | +129 | 64 |
| b | +136 | 60 |
| c | +133 | 61 |
| d | −116 | 66 |
| e | +46 | 58 |
| f | +108 | 58 |
| g | +103 | 59 |
| h | +89 | 58 |

Dry-type Fine Silica Powder "b"

A diluent containing 5 g of γ-aminopropyltrimethoxysilane and 5 g of hexyltrimethoxysilane in 15 g of toluene were slowly dropped to 100 g of fumed silica (Aerosil, Japan Aerosil Co.) with stirring by Vitamix, followed by strong stirring for 10 min. The obtained dry-type fine silica powder was then heated at 150° C. in an oven and crushed to give dry-type silica fine powder "b" having positively charged polar group (amino group) and hydrophobic group (hexyl group) on its surface.

Dry-type Fine Silica Powder "c"

5 g of N-phenyl-γ-aminopropyltrimethoxysilane and 5 g of phenyltrimethoxysilane in 15 g of toluene were slowly dropped to 100 g of the above Aerosil, Japan Aerosil Co.) with stirring by Vitamix, followed by strong stirring for 10 min. The obtained dry-type fine silica powder was then heated at 150° C. in an oven and crushed to give dry-type silica fine powder "c" having positively charged polar group (phenylamino group) and hydrophobic group (phenyl group) on its surface.

Dry-type Fine Silica Powder "d"

5 g of N-β-aminoethyl-γ-aminopropyltrimethoxysilane and 5 g of dimethylsilicone oil in 15 g of toluene were slowly dropped to 100 g of the above Aerosil, with stirring by Vitamix, followed by strong stirring for 10 min. The obtained dry-type fine silica powder was then heated to 150° C. in an oven and crushed to give dry-type silica fine powder "d" which was supplied with positively charged polar group (amino group) and was treated with a hydrophobicifying agent to make material hydrophobic.

Wet-type Fine Silica Powder "e"

5 g of aminopropyltrimethoxysilane and 5 g of methyl hydrogen silicone oil were dissolved into 100 g of toluene. 100 g of above-mentioned E-200 was dipped into the obtained solution, and the mixture was stirred and heated at 120° C. for drying and crushed using Pinmill to give dry-type silica fine powder "e" which was supplied with positively charged polar group (amino group) and was treated with an agent to make material hydrophobic with silicone oil.

Wet-type Fine Silica Powder "f"

Five grams of 3,3,3-trifluoropropyltrimethoxysilane and 5 g of γ-aminopropyltrimethoxysilane were dissolved in 100 g of toluene, 100 g of the above E-200 was mixed with the resultant solution with stirring, and the mixture was heated at 120° C., dried, and crushed using a pin mill to give silica f which has on its surface a positively charged polar group (amino group) and a negatively charged fluorinated polar group (trifluoropropyl group).

Wet-type Fine Silica Powder "g"

5 g of 4,4,5,5,6,6,7,7,8,8,8-undecafluorooctyltrimethoxysilane and 5 g of N-β-aminoethyl-γ-aminopropyltrimethoxysilane were dissolved in 100 g of toluene, 100 g of the above E-200 was dipped to obtain a mixture solution. The mixture solution was stirred, heated at 120° C., dried, and crushed using a pin mill to give wet-type silica g which has on its surface a positively charged polar group (amino group) and a negatively charged fluorinated polar group (undecafluorooctyl group).

Wet-type Fine Silica Powder "h"

5 g of 7,7,8,8,9,9,9-heptafluorononyltrimethoxysilane and 5 g of N-phenyl-γ-aminopropyltrimethoxysilane were dissolved in 100 g of toluene, 100 g of the E-200 was mixed with the resultant solution with stirring, and the mixture was heated at 120° C., dried, and crushed using a pin mill to give silica h which has on its surface a positively charged polar group (phenylamino group) and a negatively charged fluorinated polar group (heptafluorononyl group).

(3) Evaluation of MICR Toner

Obtained MICR toner, and dry-type silica fine powder and wet-type silica fine powder as external additives were each charged into a printer (Kyocera Co., Ltd., Ecosys FS-3700), fonts (E-13B type) and were continuously printed on checks, and evaluation was carried out with respect to properties such as image density in a way similar to Example 1.

Blow-off electrification amount of MICR toner to which external additives were added was determined at the early stage, after 300,000 sheets printing, and in hot and humid environment (temperature, 33° C.; humidity, 85% RH)

TABLE 4

| | Example 7 | | | Example 8 | | | Example 8 | | | Example 9 | | |
|---|---|---|---|---|---|---|---|---|---|---|---|---|
| | Early stage | Print | Environment | Early stage | Print | Environment | Early stage | Print | Environment | Early stage | Print | Environment |
| Kind of magnetic powder | Particulate/needle-shaped | | | Particulate/needle-shaped | | | Particulate/needle-shaped | | | Particulate/needle-shaped | | |
| Amount of magnetic powder | 40 (20/20) | | | 40 (20/20) | | | 40 (20/20) | | | 40 (20/20) | | |
| External additive 1 | Dry-type silica fine powder a 0.3 wt. % | | | Dry-type silica fine powder a 0.3 wt. % | | | Dry-type silica fine powder a 0.3 wt. % | | | Dry-type silica fine powder a 0.3 wt. % | | |
| External additive 2 | Wet-type silica fine powder f 0.3 wt. % | | | Wet-type silica fine powder g 0.3 wt. % | | | Wet-type silica fine powder h 0.3 wt. % | | | Wet-type silica fine powder f 0.3 wt. % | | |
| Residual magnetization | 14.0 emu/g | | | 14.0 emu/g | | | 14.0 emu/g | | | 14.0 emu/g | | |
| Saturation magnetization | 42.5 emu/g | | | 42.5 emu/g | | | 42.5 emu/g | | | 42.5 emu/g | | |
| Dispersibility | Good | Good | Good | Good | Good | Good | Good | Good | Good | Good | Good | Good |
| Durability | Good | Good | Good | Good | Good | Good | Good | Good | Good | Good | Good | Good |
| Overlapping | 4.0 | 4.0 | 4.0 | 4.0 | 4.0 | 4.0 | 4.0 | 4.0 | 4.0 | 4.0 | 4.0 | 4.0 |
| Image density | 1.25 | 1.25 | 1.20 | 1.28 | 1.26 | 1.22 | 1.31 | 1.31 | 1.22 | 1.26 | 1.24 | 1.25 |

TABLE 4-continued

| | Example 7 | | | Example 8 | | | Example 8 | | | Example 9 | | |
|---|---|---|---|---|---|---|---|---|---|---|---|---|
| | Early stage | Print | Environment | Early stage | Print | Environment | Early stage | Print | Environment | Early stage | Print | Environment |
| Readability | 120 | 130 | 120 | 119 | 126 | 121 | 122 | 119 | 119 | 122 | 121 | 116 |
| Electrification amount | 14.8 | 14.2 | 14.4 | 14.4 | 14.2 | 13.9 | 15.1 | 15.2 | 14.9 | 13.9 | 13.3 | 14.0 |

* Values in the parentheses in "Amount of magnetic powder" indicate weight ratio of particulate/needle-shaped

TABLE 5

| | Example 10 | | | Example 11 | | | Example 12 | | | Example 13 | | |
|---|---|---|---|---|---|---|---|---|---|---|---|---|
| | Early stage | Print | Environment | Early stage | Print | Environment | Early stage | Print | Environment | Early stage | Print | Environment |
| Magnetic powder | Particulate/needle-shaped | | | Particulate/needle-shaped | | | Particulate/needle-shaped | | | Particulate/needle-shaped | | |
| Amount of magnetic powder | 40 (20/20) | | | 40 (20/20) | | | 40 (20/20) | | | 40 (20/20) | | |
| External additive 1 | Dry-type silica fine powder b 0.3 wt. % | | | Dry-type silica fine powder c 0.3 wt. % | | | Dry-type silica fine powder c 0.3 wt. % | | | Dry-type silica fine powder d 0.3 wt. % | | |
| External additive 2 | Wet-type silica fine powder g 0.3 wt. % | | | Wet-type silica fine powder f 0.3 wt. % | | | Wet-type silica fine powder g 0.3 wt. % | | | Wet-type silica fine powder e 0.3 wt. % | | |
| Residual magnetization | 14.0 emu/g | | | 14.0 emu/g | | | 14.0 emu/g | | | 14.0 emu/g | | |
| Saturation magnetization | 42.5 emu/g | | | 42.5 emu/g | | | 42.5 emu/g | | | 42.5 emu/g | | |
| Dispersibility | Good | Good | Good | Good | Good | Good | Good | Good | Good | Good | Good | Good |
| Durability | Good | Good | Good | Good | Good | Good | Good | Good | Good | Good | Good | Good |
| Overlapping | 4.0 | 4.0 | 4.0 | 4.0 | 4.0 | 4.0 | 4.0 | 4.0 | 4.0 | 4.0 | 4.0 | 4.0 |
| Image density | 1.26 | 1.24 | 1.22 | 1.33 | 1.29 | 1.27 | 1.31 | 1.26 | 1.24 | 1.24 | 1.22 | 1.22 |
| Readability | 116 | 122 | 108 | 119 | 121 | 116 | 122 | 122 | 119 | 116 | 119 | 116 |
| Electrification amount | 15.4 | 14.8 | 15.0 | 13.9 | 13.9 | 14.2 | 15.1 | 14.9 | 15.0 | 14.6 | 14.8 | 14.4 |

* Values in the parentheses in "Amount of magnetic powder" indicate weight ratio of particulate/needle-shaped According to the present invention, it has become possible to provide a MICR toner, which is excellent in the image density, the readability, the durability and the dispersibility, the containing binder resin and the magnetic powder, by using two kinds of magnetic powders, i.e., the first and second magnetic powders having different residual magnetization and by controlling residual magnetization of MICR toner to be within a range of 7.0 to 20 emu/g (but exclusive of 7.0 emu/g). It has become also possible to provide a MICR toner, which is more excellent in image density, readability, dispersibility, and durability, by controlling the residual magnetization value, the saturation magnetization value, the aspect ratio, the BET value, the bulk density, shape, the loadings of the magnetic powder, and the blending ratio of the two kinds of magnetic powders, i.e., the first and second magnetic powders.

Addition of both dry-type silica fine powder and wet-type silica fine powder as external additives enabled the toner to have excellent electrification without being influenced by environmental condition (humidity) andmade it possible to provide MICR toner having more excellent properties in image density and reading accuracy, and excellent properties in durability and dispersibility of magnetic powder.

What is claimed is:

1. A magnetic toner for a MICR printer, containing a binder resin and a magnetic powder, said magnetic powder including a first magnetic powder having a residual magnetization value within a range of 24 to 40 emu/g and a second magnetic powder having a residual magnetization value within a range of 1 to 24 emu/g (but exclusive of 24 emu/g), said magnetic toner for a MICR printer having a residual magnetization value within a range of 7 to 20 emu/g (but exclusive of 7 emu/g).

2. The magnetic toner for a MICR printer according to claim 1, wherein said first magnetic powder has a saturation magnetization value within a range of 80 to 85 emu/g, and wherein said second magnetic powder has a saturation magnetization value within a range of 85 to 90 emu/g (but exclusive of 85 emu/g).

3. The magnetic toner for a MICR printer according to claim 1, wherein said first magnetic powder has an aspect ratio (long diameter/short diameter) within a range of 2.0 to 100, and wherein said second magnetic powder has an aspect ratio (long diameter/short diameter) within a range of 1.0 to 2.0 (but exclusive of 2.0).

4. The magnetic toner for a MICR printer according to claim 1, wherein said first magnetic powder has a BET value within a range of 13 to 30 $m^2/g$, and wherein said second magnetic powder has a BET value within a range of 1 to 13 $m^2/g$ (but exclusive of 13 $m^2/g$).

5. The magnetic toner for a MICR printer according to claim 1, wherein said first magnetic powder has a bulk density within a range of 1 to 1.2 $g/cm^3$, and wherein said second magnetic powder has a bulk density within a range of 1.2 to 2.0 $g/cm^3$ (but exclusive of 1.2 $g/cm^3$).

6. The magnetic toner for a MICR printer according to claim 1, wherein said first magnetic powder is needle-shaped, and wherein said second magnetic powder is granule-shaped.

7. The magnetic toner for a MICR printer according to claim 1, wherein loadings of said magnetic powder are within a range of 1 to 60 parts by weight per 100 parts by weight of said binder resin.

8. The magnetic toner for a MICR printer according to claim 1, wherein in said magnetic powder, loadings of said second magnetic powder are within a range of 10 to 1000 parts by weight when loadings of said first magnetic powder are 100 parts by weight.

9. The magnetic toner for an MICR printer according to claim 1, wherein dry-type silica fine powder and wet-type silica fine powder are used together as external additives.

* * * * *